US012448868B2

(12) United States Patent
Owunari

(10) Patent No.: US 12,448,868 B2
(45) Date of Patent: Oct. 21, 2025

(54) DEWAXER FLOW ENHANCER SYSTEM AND METHOD

(71) Applicant: Brown Ricky Owunari, Missouri City, TX (US)

(72) Inventor: Brown Ricky Owunari, Missouri City, TX (US)

(73) Assignee: Brown Ricky Owunari, Missouri City, TX (US)

( * ) Notice: Subject to any disclaimer, the term of this patent is extended or adjusted under 35 U.S.C. 154(b) by 0 days.

(21) Appl. No.: 18/565,827

(22) PCT Filed: Apr. 2, 2021

(86) PCT No.: PCT/IB2021/052782

§ 371 (c)(1),
(2) Date: Nov. 30, 2023

(87) PCT Pub. No.: WO2021/199000

PCT Pub. Date: Oct. 7, 2021

(65) Prior Publication Data

US 2024/0287873 A1 Aug. 29, 2024

(51) Int. Cl.

| | |
|---|---|
| ***E21B 36/04*** | (2006.01) |
| ***E21B 37/10*** | (2006.01) |
| ***E21B 47/06*** | (2012.01) |

(52) U.S. Cl.
CPC ..... *E21B 37/10* (2013.01); *E21B 36/04* (2013.01); *E21B 47/06* (2013.01)

(58) Field of Classification Search
CPC ..... E21B 36/04; C09K 8/34
USPC ..... 166/302
See application file for complete search history.

(56) References Cited

U.S. PATENT DOCUMENTS

| | | | | |
|---|---|---|---|---|
| 7,032,675 | B2 * | 4/2006 | Steele | E21B 43/24 166/205 |
| 8,955,591 | B1 * | 2/2015 | Hytken | E21B 36/00 166/57 |
| 9,388,686 | B2 * | 7/2016 | Konopczynski | E21B 47/114 |
| 2017/0204702 | A1 * | 7/2017 | Hansen | E21B 33/068 |
| 2017/0356280 | A1 * | 12/2017 | Sylvester | E21B 43/38 |

* cited by examiner

*Primary Examiner* — William D Hutton, Jr.
*Assistant Examiner* — Ashish K Varma
(74) *Attorney, Agent, or Firm* — Argus Intellectual Enterprise, LLC; Daniel Enea; Jordan Sworen

(57) ABSTRACT

A dewaxer flow enhancer. The dewaxer flow enhancer provides heat to the crude oil within tubing of a well bore in a drilling operation and collects the wax in a swab cup. The dewaxer flow enhancer includes a body having a head and a dewaxing barrel. The dewaxing barrel delivers heat via an induction heater and includes a tip that forms a path for the dewaxer flow enhancer as it oscillates and reciprocates within the tubing. Once sufficiently heated, wax in the crude oil has a lower viscosity and is collected via a swab cup of the head. An actuator is coupled to the dewaxer flow enhancer via a slickline or e-line and controls the position within the tubing. A controller regulates the heat and sensors detect properties of the crude oil.

16 Claims, 9 Drawing Sheets

DEWAXER FLOW ENHANCER SYSTEM AND METHOD

CROSS REFERENCE TO RELATED APPLICATION

This application claims the benefit of N.G. Application No. NG/PT/NC/2020/4457 filed on Apr. 2, 2020, and PCT/IB2021/052782 filed on Apr. 2, 2021. The above identified patent application is herein incorporated by reference in its entirety.

BACKGROUND OF THE INVENTION

The present invention relates to a dewaxer flow enhancer system and method of removing wax or waxy substances from a well bore. The present invention further provides a dewaxer flow enhancer system having an elongated cylindrical body having a head at a first end and a dewaxing barrel at a second end. The dewaxer flow enhancer delivers heat to the crude oil in drilling operations and collects the dewaxed substances in a swab cup to be removed at the surface.

In the process of drilling an oil well, a borehole is formed that extends deep into the earth in an effort to remove the oil. Oil reservoirs are porous and to remove the oil from the reservoirs often requires that the oil move through the pores in the rock. If the pores are blocked, then it is difficult and it may even become impossible to remove the oil from the reservoir, with consequent economic loss to the oil well owner. Wax is commonly found in many drill sites and may be particularly present in select drill sites. The oil in many, if not most, reservoirs contain waxes. A wax is normally defined as a hydrocarbon that is a solid at room temperature. These waxes may be dissolved in the oil. In some cases, however, the waxes may partially block the pores, or, as production continues, the very action of removing oil from a reservoir may cause the wax to precipitate out of solution and block the tubing of the well bore. Also, the wax may precipitate out of solution in equipment used for the production of oil and gas and reduce or block the flow of oil from the well.

These wax formations create flow assurance problems in the production and transportation of waxy crude oil. The economic damage from wax precipitation can be very high, killing some oil wells entirely. Consequently, a great deal of attention has been devoted to developing cost effective ways of preventing wax from precipitating out of solution or of removing the wax from an oil reservoir or well bore. This is especially applicable when wax precipitation and deposition creates major flow assurance problem in the production and transportation of waxy crude oil in deep-water developments.

Wax crystallization begins with the formation of stable nuclei consisting of clusters of paraffin molecules, followed by crystal growth as increasing number of paraffin wax molecules attach themselves to the nuclei, and finally agglomeration. Wax precipitation changes oil flow properties, increasing oil viscosity and the risk of gelation. This results in higher energy requirement to pump oil and difficulty in restarting flow if oil gels, due to high yield stress of the wax.

One such attempt at a solution has been to apply to a chemical injection, such as a flow improver, to waxy crude in order to reduce handling cost. These chemical injections of flow improvers sustain flow and helps to reduce the frequency of expensive wax remedial operations, such as pigging. However, these flow improver chemicals contaminate the formation fluid and increase cost of proper separation in later processing.

Another such attempt at a solution has been the application of hot oil into the well. However, should the oil spill there is significant environmental pollution that causes damage and requires remedial action. Additionally, the regulation of temperature of the hot oil may cause ignition where the formation fluid contains dissolved gases. The uncontrolled heat may also cause a ballooning effect.

The present dewaxer flow enhancer system applies heat locally within the tubing of the well bore and removes the wax from the tubing. The heat applied by the dewaxer flow enhancer is regulated and controlled and does not utilize a chemical application. Thereby, the dewaxer flow enhancer eliminates the environmental impact of using a chemical injection while removing wax substances from the tubing of the well bore to increase flow. The system and method ensure safe, effective removal of waxy substances.

In light of the devices disclosed in the known art, it is submitted that the present invention substantially diverges in design elements and methods from the known art and consequently it is clear that there is a need in the art for an improvement of a dewaxer flow enhancement system and method. In this regard the instant invention substantially fulfills these needs.

SUMMARY OF THE INVENTION

In view of the foregoing disadvantages inherent in the known types of dewaxers systems now present in the known art, the present invention provides a new dewaxer flow enhancer system and method of dewaxing wherein the same can be utilized for removing wax or waxy substances from a well bore.

It is an objective of the present invention to provide a dewaxer flow enhancer system comprising an elongated cylindrical body having a head at a first end and a dewaxing barrel at a second end sized to fit within a tubing of the well bore. The dewaxing barrel comprises a tip at a distal end thereof that is adapted to deliver heat to downhole crude oil so as to form a low viscosity paraffin wax.

It is yet another objective of the present invention to provide a dewaxer flow enhancer system that is an assembly that can be disassembled for transportation and maintenance.

It is another objective of the present invention to provide a dewaxer flow enhancer system wherein the head comprises a swab cup for collecting the low viscosity paraffin wax from the tubing of the well bore. As the dewaxer flow enhancer system reciprocates within the tubing, the swab cup collects the wax for later discharge. The swab cup is also in fluid communication with swab tank, wherein the dewaxer flow enhancer system is adapted to discharge the low viscosity paraffin wax collected by the swab cup to a swab tank.

It is another objective of the present invention to provide a dewaxer flow enhancer system having a fastener at the head for selectively coupling the dewaxer flow enhancer to a slickline or an e-line. The dewaxer flow enhancer system is adapted to reciprocate within the tubing of the well bore between a bottom hole position and a top well position via an actuator. In this way, the dewaxer flow enhancer system performs cycles of descending into the tubing of the well bore into the bottom hole position, heating the crude oil, collecting the low viscosity paraffin wax via the swab cup, ascending to the surface, and discharging the low viscosity paraffin wax in a top well position.

It is another objective of the present invention to provide a dewaxer flow enhancer system and method configured to regulate heat in a safe manner to degrade wax deposits and enhance flow of oil.

It is another objective of the present invention to provide a dewaxer flow enhancer system and method configured to remove wax deposits from the tubing of the well bore via the swab cup and swab tank to enhance the flow of oil.

It is yet another objective of the present invention to provide a dewaxer flow enhancer system and method configured to enhance the flow of oil without the use of a chemical injection that inhibits or forms an emulsion.

It is yet another objective of the present invention to provide a dewaxer flow enhancer system and method configured to collect information of the tubing of the well bore via sensors to determine the properties of the crude oil, the low viscosity paraffin wax, and the tubing of the well bore. The properties include temperature, viscosity, pressure, composition, flow, and the like.

It is also another objective of the present invention to provide a method of dewaxing a tubing of the well bore to enhance flow. The method comprises providing a dewaxer flow enhancer, positioning the dewaxer flow enhancer within the tubing of the well bore, applying heat via the dewaxing barrel to the downhole crude oil to form low viscosity wax, and collecting the low viscosity wax from the tubing of the well bore via the swab cup.

It is therefore an object of the present invention to provide a new and improved dewaxer flow enhancer that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for dewaxing tubing of an oil well bore. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment. As used herein, "wax" or "waxy" may be used interchangeably with "paraffin". As used herein, "low viscosity wax" refers to melting or otherwise degrading solidified wax to a more flowable state, such that it releases from the tubing and can be collected by the present invention. As used herein "line" refers to either a slickline, an e-line, or the like.

Figure 1:
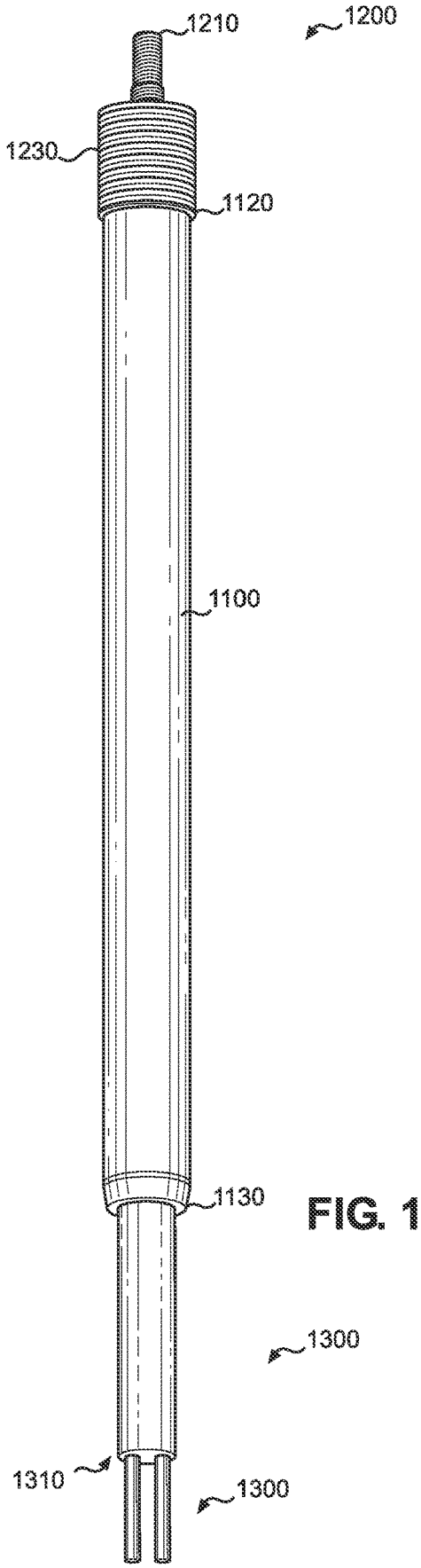
FIG. 1 shows a perspective view of one embodiment of the dewaxer flow enhancer system.
Figure 2:
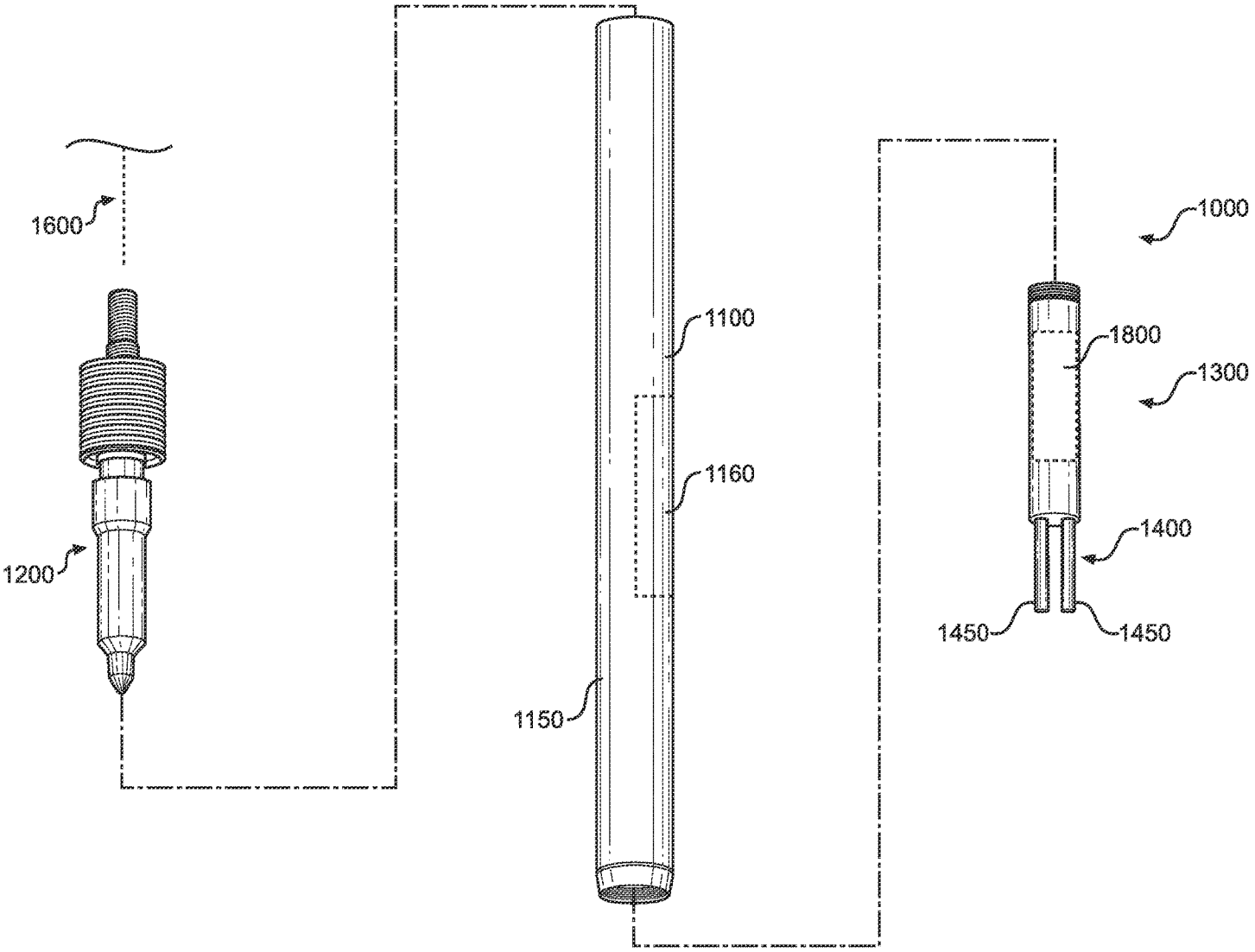
FIG. 2 shows an exploded view of one embodiment of the dewaxer flow enhancer system.

Referring now to FIGS. 1 and 2, there is shown a perspective view and an exploded view of one embodiment of the dewaxer flow enhancer system, respectively. The dewaxer flow enhancer system 1000 provides an elongated cylindrical body 1100 having a head 1200 at a first end 1120 and a dewaxing barrel 1300 at a second end 1130. The first and second ends 1120, 1130 are positioned on opposing ends of the body 1100 when viewed along a longitudinal axis thereof. The dewaxing barrel 1300 comprising a tip 1400 at a distal end 1310 thereof.

In the crude oil production process, wax contained in the crude oil is continuously separated from the crude oil, wherein it is condenses on the tubing wall. Over time, the wax accumulates, and the oil flow will be stopped or restricted. The dewaxing barrel 1300 is adapted to deliver heat to downhole crude oil so as to form a low viscosity paraffin wax to prevent separation and subsequent blockage along the tubing wall. The delivery of heat to the crude oil causes the wax to become less viscous and more easily releases from the tubing or pipe sidewall.

Figure 8:
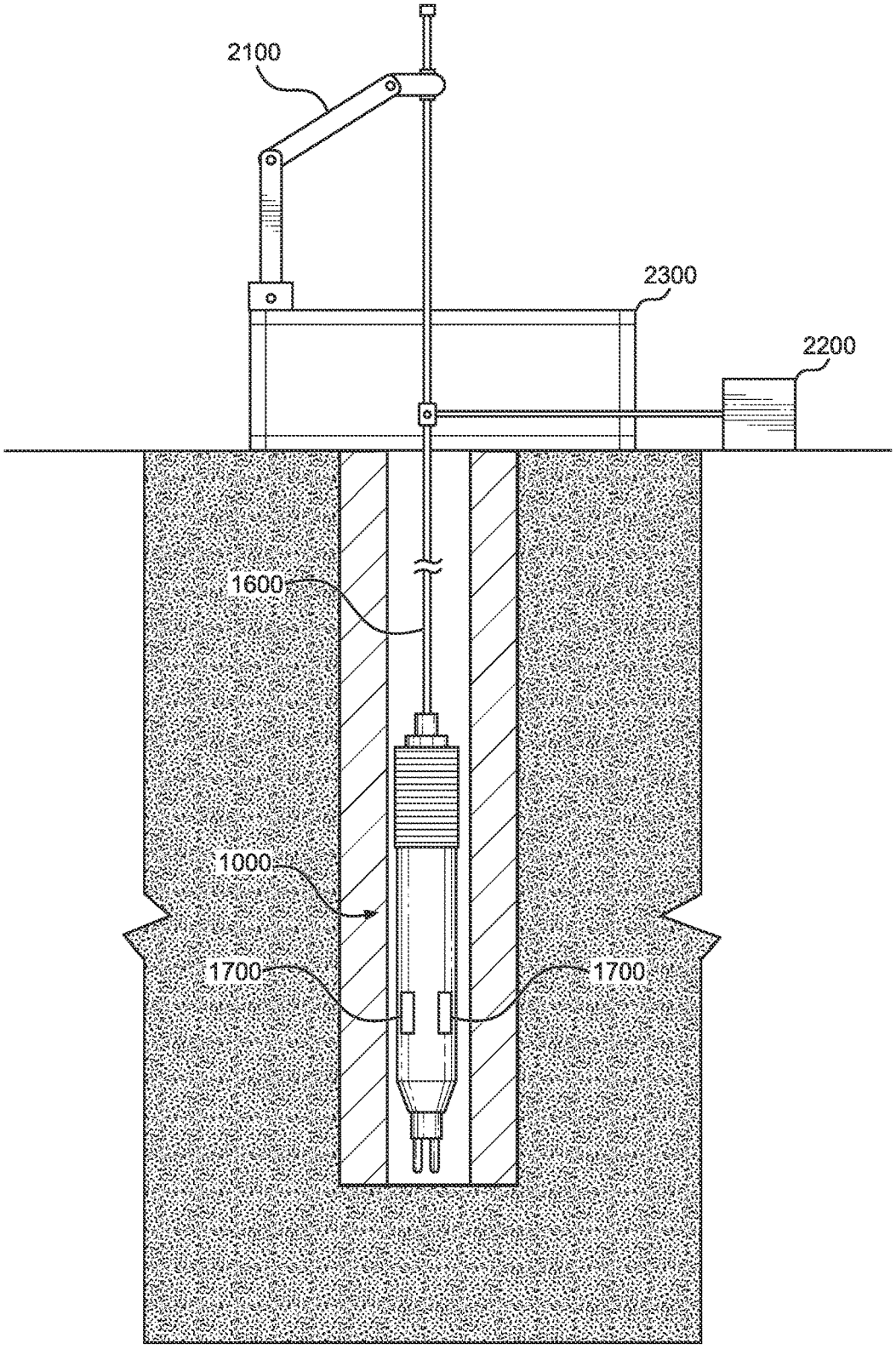
FIG. 8 shows a schematic view of one embodiment of the dewaxer flow enhancer system in a bottom well position.

In one embodiment, the head 1200 comprises a swab cup 1230 for collecting the low viscosity paraffin wax from the tubing of the well bore and a fastener 1210 for selectively coupling a slickline or an e-line 1600. As shown in FIG. 8, the fastener 1210 is removably connected to the slickline or the e-line 1600 so as to position the dewaxer flow enhancer system 1000 within the tubing of the well bore.

In the shown embodiment, the general outer dimensions of the head 1200 is the same or greater than the body 1100 and dewaxing barrel 1300. In alternative embodiment, the relative diameters are different so as to be accommodated within the tubing of the tubing of the well bore and for optimal heating of the crude oil and collecting of the low viscosity wax.

Referring specifically to FIG. 2, in the shown embodiment, the body 1100 is removably secured to both the head 1200 and dewaxing barrel 1300. In this way, the dewaxer flow enhancer system 1000 may be assembled and disassembled during transportation. Further, the dewaxer flow enhancer system 1000 may be selectively fitted with interchangeable components should the drilling operation require a specific configuration.

In one embodiment, an exterior sidewall 1150 of the body 1100 comprises an alloy of stainless steel adapted to protected and insulated internal components thereof. In the illustrated embodiment, the internal components comprise a power source 1160, such as a battery, (as shown in FIG. 8) in electrical communication with the dewaxing barrel 1300. In one embodiment, the heater 1800 is an induction coil operably connected to the power source 1160 of the body 1100. The heater 1800 is positioned adjacent to the tip 1400 so as to conductivity deliver heat in an effective manner. In one embodiment, the dewaxer barrel 1300 is adapted to heat the crude oil to an operating temperature of between 130 and 170 degrees Centigrade. In this range, the wax degrades and has a lower viscosity to enhance the flow and facilitate the collection via the swab cup.

In an alternative embodiment, the power source is an external power source that is located at the surface and electrically connected to the dewaxer flow enhancer 1000 via an e-line 1600. The "e-line" is an electric cable for moving tools, such as the dewaxer flow enhancer 1000 into the well bore.

In the shown embodiment, the tip 1400 of the dewaxer barrel 1300 comprises a bull nose tip 1450. The bull nose tip 1450 is shown as a pair of elongated members extending from a flat face of the distal end of the dewaxer barrel 1300. The pair of elongated members are spaced apart and provide for contact with the crude oil in operation. In one usage, the bull nose 1450 is used to orient the dewaxing barrel 1300 within the tubing and to physically engage with wax formations within the tubing and clear a path for the dewaxer flow enhancer system 1000 to move therethrough.

Figure 3:
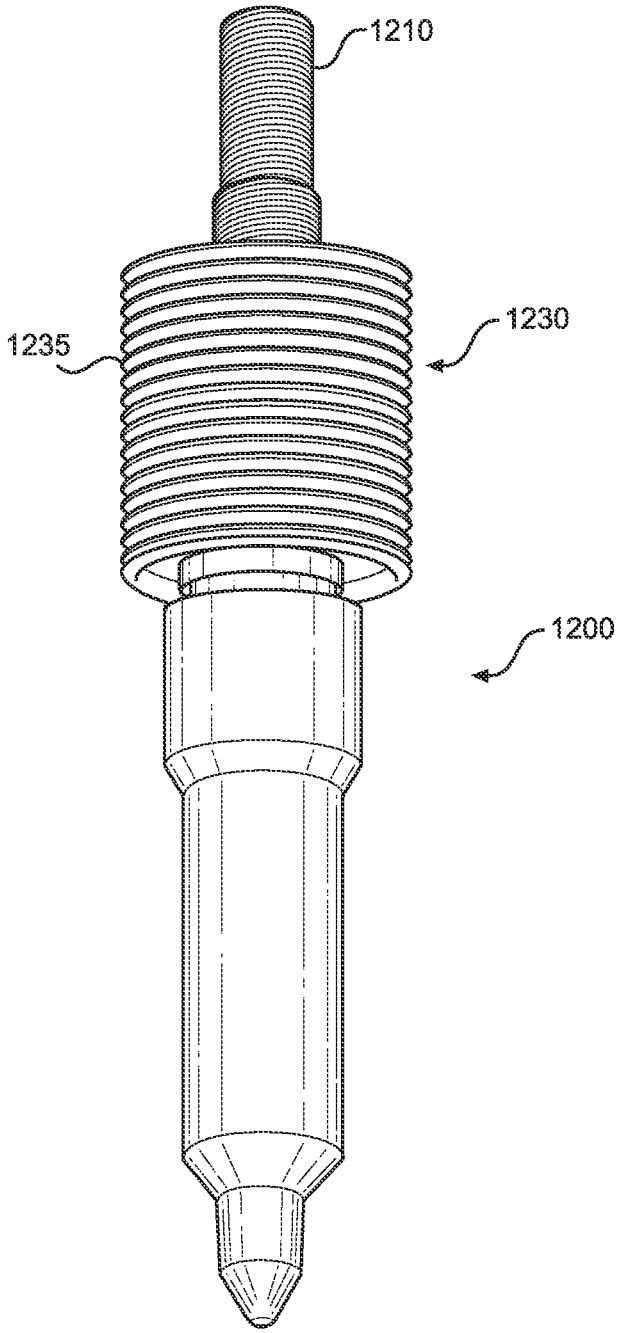
FIG. 3 shows a close-up perspective view of one embodiment of the head of the dewaxer flow enhancer system.
Figure 4:
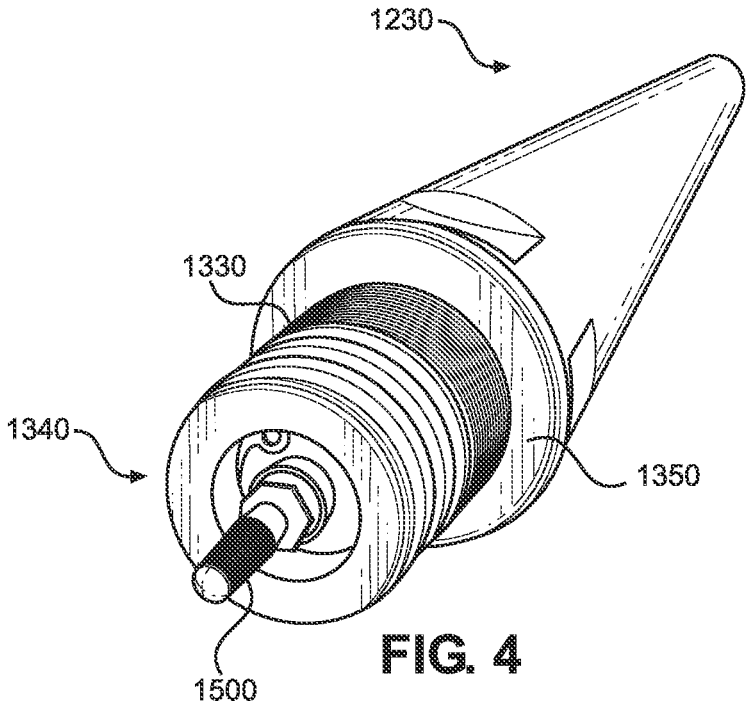
FIG. 4 shows a perspective view of a first end of one embodiment of the dewaxer barrel of the dewaxer flow enhancer system.

Referring now to FIG. 3, there is shown a close-up perspective view of one embodiment of the head of the dewaxer flow enhancer system. In the shown embodiment, the head 1200 of the dewaxer flow enhancer comprises a swab cup 1230 positioned intermediate the fastener 1210 and a lower end 1220. The lower end 1220 is sized and adapted to be received by the first end 1120 of the body 1100, as shown in FIG. 4. In the shown embodiment, the swab cup 1230 comprises a plurality of annular rings 1235 positioned along the longitudinal axis of the head 1200, each ring having generally the same diameter. A space is formed between each annular ring which assist with the collection of the low viscosity wax after the crude oil is exposed to a sufficient amount of heat. The wax collects within the swab cup 1230 when the dewaxer flow enhancer oscillates within the tubing of the well bore. For example, when the dewaxer flow enhancer is positioned at or near the bottom hole position, the dewaxer flow enhancer system oscillates within the tubing of the well bore. As the dewaxer flow enhancer oscillates, the swab cup 1230 collects the low viscosity wax. The low viscosity wax may be removed from the swab cup 1230 via a suction line or other removal element. In one embodiment, the swab cup 1230 is operably connected to a swab tank (shown in FIG. 8) when in a top well position. In the shown embodiment, the fastener 1210 for selectively coupling a slickline or an e-line 1600 is show extending distally from the swab cub 1230.

Figure 5:
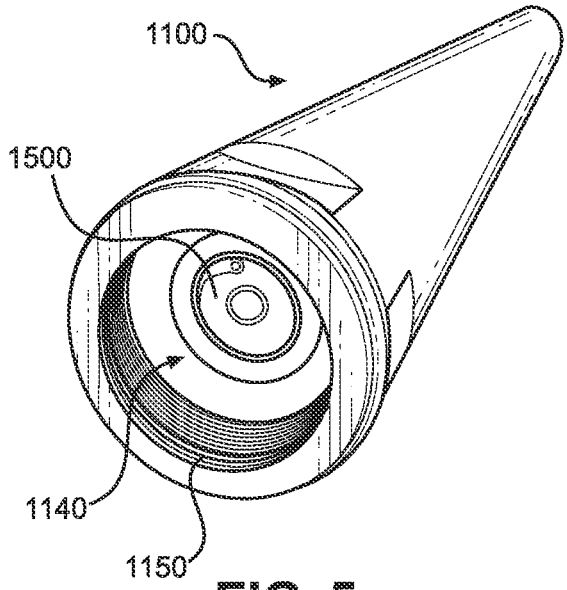
FIG. 5 shows a perspective view of one embodiment of the second end of the body of the dewaxer flow enhancer system with the dewaxer barrel removed therefrom.

Referring now to FIGS. 4 and 5, there is shown a first end of one embodiment of the dewaxer barrel of the dewaxer flow enhancer system and a perspective view of one embodiment of the second end of the body of the dewaxer flow enhancer system with the dewaxer barrel removed therefrom, respectively. In the shown embodiment, the proximal end 1320 of the dewaxer barrel 1300 comprises a first fastener 1330 mounted to a post 1340 extending from a shoulder 1350. The first fastener 1330 is threads extending about the post 1340, being sized to be received by the channel 1140 of the body 1100. The channel 1140 includes corresponding threading 1150 disposed on an interior sidewall of the body 1100. The body and dewaxing barrel 1100, 1300 each include an electrical connector 1500 for coupling the power source of the body 1100 with the heating element in the barrel 1300. In the shown embodiment, the male and female connectors 1500 are configured to mate upon the coupling of the body and dewaxing barrel fasteners 1150, 1330. However, other embodiments are contemplated using any suitable mating connector configuration.

Figure 6:
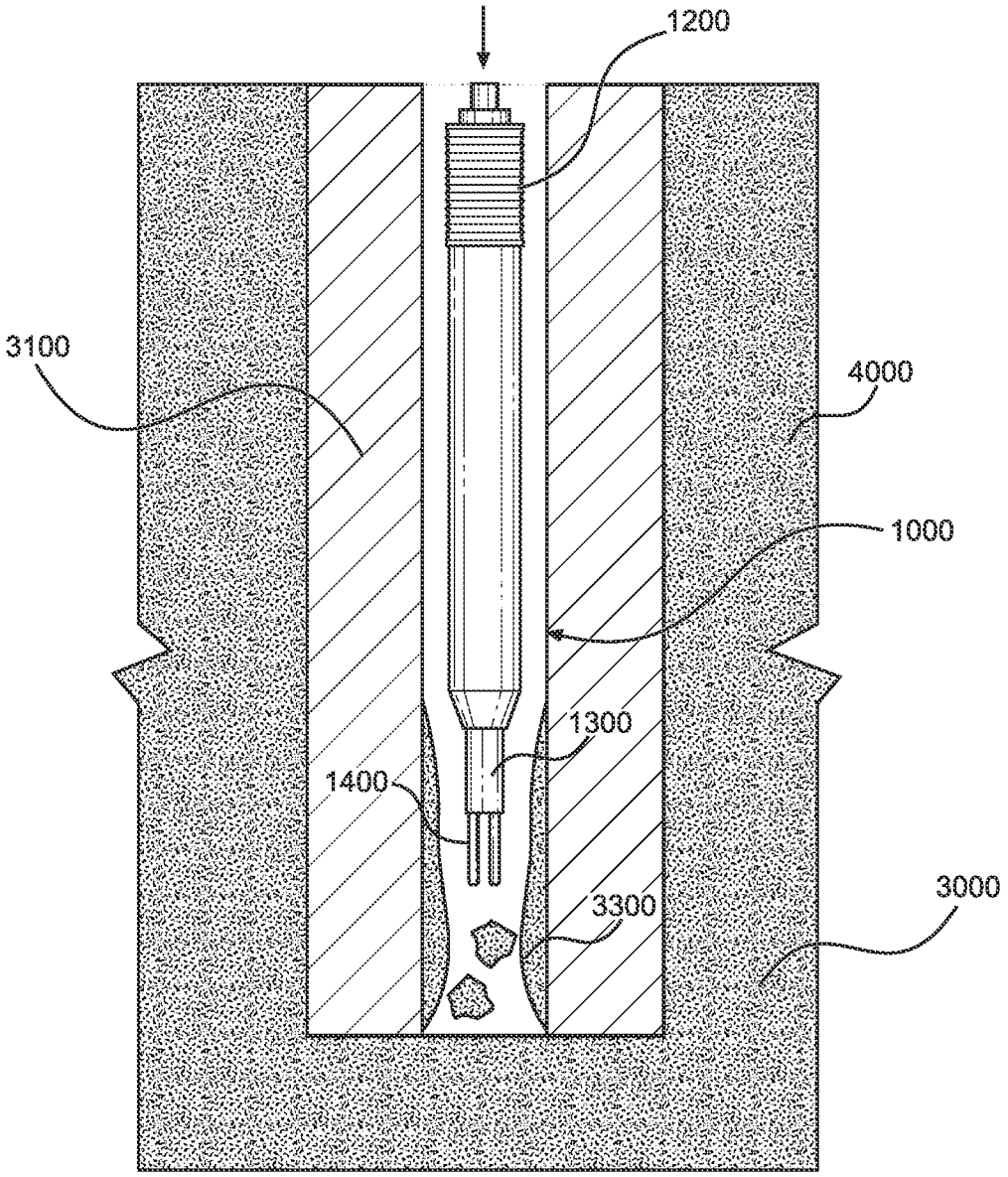
FIG. 6 shows a side view of one embodiment of the dewaxer flow enhancer system in a bottom well position and the wax substance forming in the tubing of the well bore.
Figure 7:
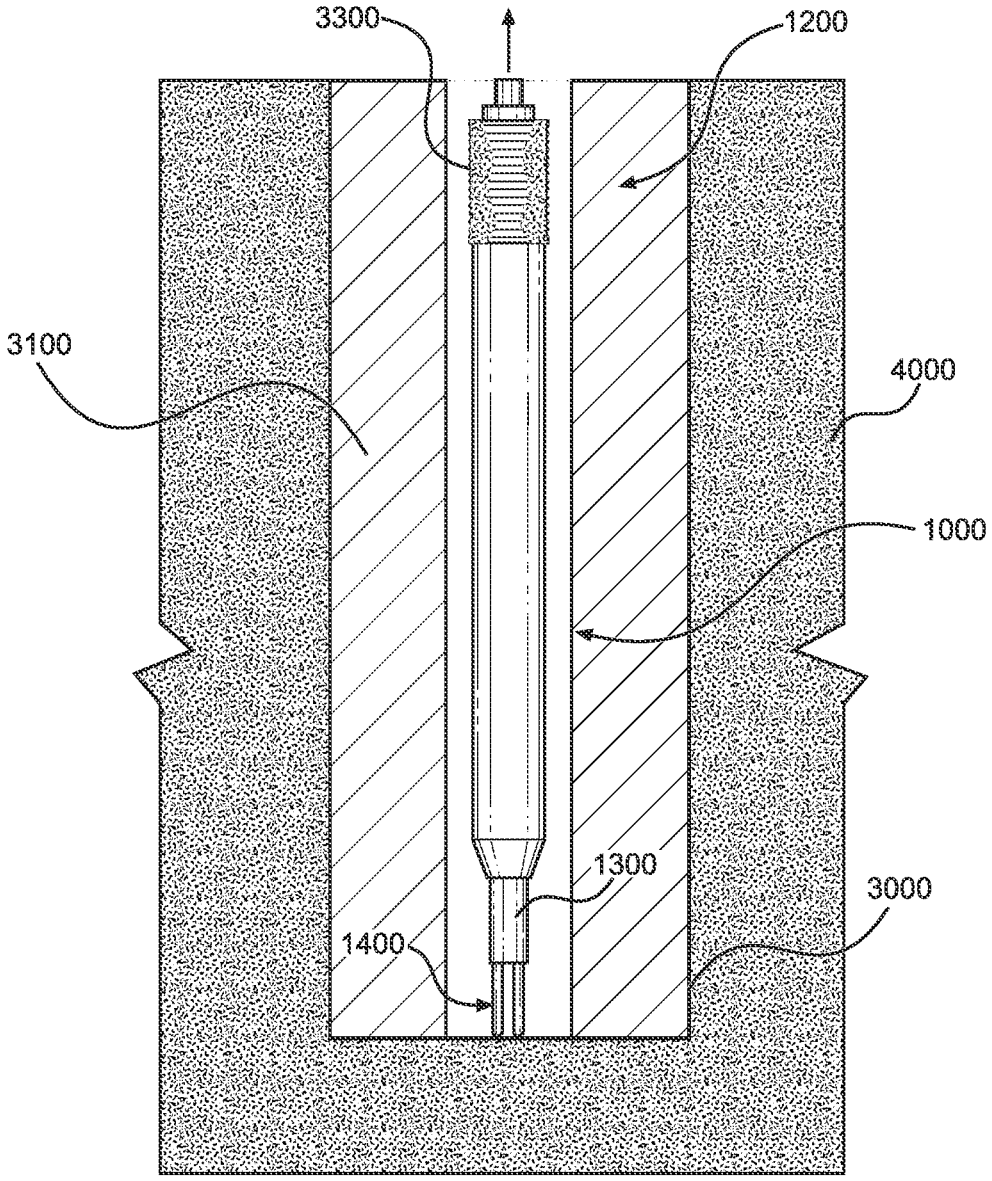
FIG. 7 shows a side view of one embodiment of the dewaxer flow enhancer system being oscillated from a bottom well position and the wax substance being collected in the swap cup.

Referring now to FIGS. 6 and 7, there is shown a side view of one embodiment of the dewaxer flow enhancer system in a bottom well position and the wax substance forming in the well and a side view of one embodiment of the dewaxer flow enhancer system being oscillated from the bottom well position and the wax substance being collected in the swap cup, respectively.

In the shown embodiment, the well bore 3000 is shown extending through a rock formation 4000. The well bore 3000 is a drilled hole or borehole. Well bore tubing 3100 is positioned within the well bore 3000 and extends concentrically to a desired depth.

In the shown embodiment, the dewaxer flow enhancer system 1000 is adapted to reciprocate within the tubing 3100 of the well bore between a bottom hole position and a top well position via an actuator. In the bottom hole position, the tip 1400 is positioned within the well bore to engage the crude oil. The dewaxing barrel 1300 is positioned distal to the body 1100 and is adapted to deliver heat directly to the crude oil. In the shown embodiment, wax 3300 is formed along the side of the tubing 3100 blocking or partially blocking the oil from flowing as desired.

In one use, the dewaxer flow enhancer system 1000 is transported to the bottom hole position to apply heat and collect the wax. The dewaxing barrel 1300 is operably connected to the heater and is thermally regulated. Within the tubing, the heat causes the crude oil having wax elements therein to become less viscous and be removed from the sidewall of the tubing. The shape of the bull tip nose 1400 provides for additional surface area with the crude oil when passing therethrough. The tip 1400 assists with the movement of the dewaxer flow enhancer system 1000 as it oscillates within the tubing by bearing against any wax that is deposited on the tubing. Once a sufficient quantity of wax is collected in the swab cup (for example if the swab cup is full), the dewaxer flow enhancer system 1000 returns towards the surface in a top well position. In the top well position, the head 1200 is adapted to discharge the low viscosity paraffin wax collected by the swab cup to a swab tank. In one embodiment, a suction tube pumps the collected wax from the swab cup. The dewaxer flow enhancer system 1000 may perform this cycle of being lowered to the bottom well position, degrading wax molecule via application of regulated heat, collecting the wax through oscillating within the tubing, returning to the top well position, and discharging the collected wax, many times before desirable oil flow is achieved within the tubing 3100. In some embodiments, a single cycle may be performed within fifteen minutes and the entire series of cycles take two to three days to achieve desirable flow. As shown in FIG. 7, the wax 3300 deposits on the tubing 3100 of FIG. 6, are removed after treatment.

In one embodiment, the dewaxer flow enhancer system 1000 vacillates or oscillates within the tubing while oil continues to flow through. The oscillation occurs within the tubing and may range from ten to thousands of feet. Additionally, the oscillation may occur at the bottom hole position or between the bottom hole position and the top hole position. During the oscillation, the heat is degrading the wax to a lower viscosity and the swab cup is collecting the low viscosity wax. In other embodiments, the oil collection is halted during the dewaxing process.

Referring now to FIG. 8, there is shown a schematic view of one embodiment of the dewaxer flow enhancer system in a bottom well position. In the shown embodiment, the dewaxer flow enhancer system 1000 is operably connected to an actuator 2100 that controls the position and depth of the dewaxer flow enhancer system 1000 within the tubing of the well bore. The actuator 2100 may be any mechanism, such as a crane, mast, or the like that controls the position of the dewaxer flow enhancer 1000 via the slickline or e-line 1600. The e-line 1600 is also in communication with a controller 2200 that automatically or manually controls the operation of the dewaxer flow enhancer system 1000. In one use, the controller 2200 regulates the temperature of the dewaxing barrel and the duration of the application of heat.

In some embodiments, the controller 2200 is operably connected to a sensor 1700 of the dewaxer flow enhancer system 1000. The sensor 1700 is adapted for detecting temperature of crude oil. In some embodiments, the sensor is also adapted for detecting viscosity of the crude oil. The sensor 1700 may be positioned anywhere internally or externally of the dewaxer flow enhancer system 1000. Additionally, the sensors are adapted to detect flow of the oil through the tubing, as well as density and API gravity (defined by the American Petroleum Institute (API)).

In the shown embodiment, the swab cup is in fluid communication with the swab tank 2300. In the top well position, the low viscosity wax collected by the swab cup is suctioned therefrom and stored in the swab tank 2300. The swab tank 2300 prevents unwanted spillage therefrom and allows for samples to be taken and tested.

Figure 9:
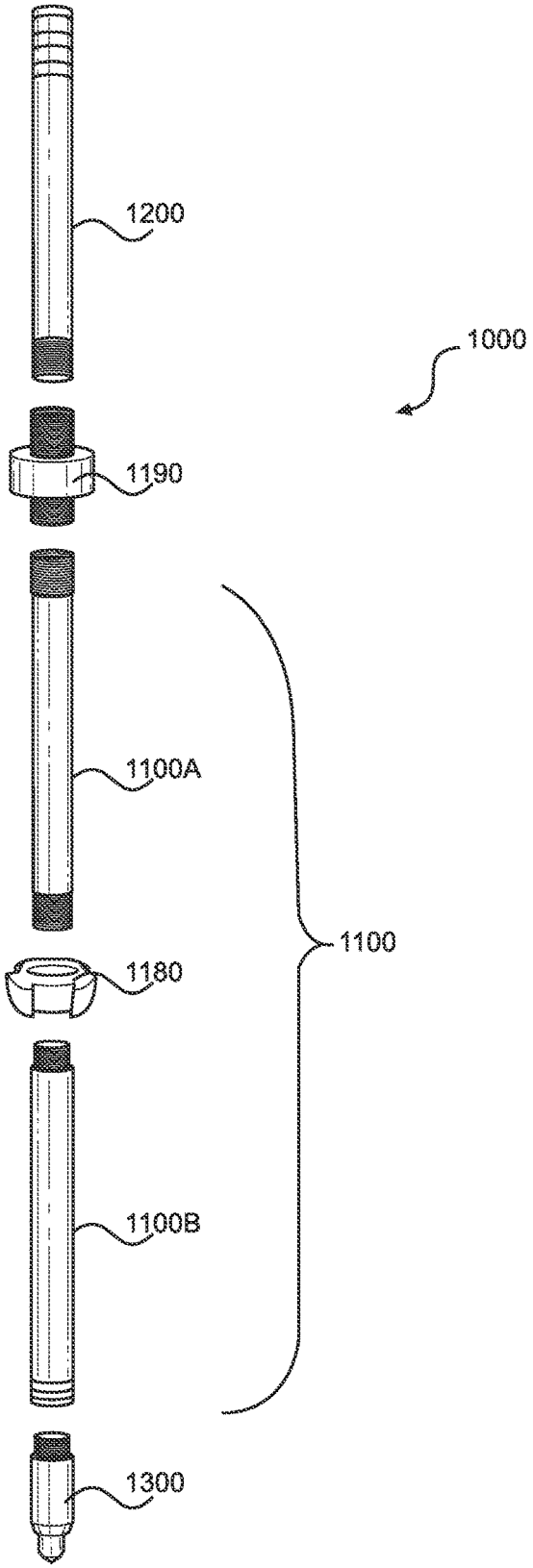
FIG. 9 shows an exploded view of one embodiment of the dewaxer flow enhancer system.

Referring to FIG. 9, there is shown an exploded view of one embodiment of the dewaxer flow enhancer system. In the shown embodiment, the body 1100 comprises a pair of sections 1100A, 1100B that are removable coupled to each other via threaded fasteners. In other embodiments, the body 1100 may comprise any number of sections that alter the length of the body 1100. The embodiment also includes a scraper 1180 positioned between the sections 1100A, 1100B. The scraper 1180 comprises a central aperture sized to fit along an exterior of the body 1100 and one or more protruding blades extending generally radially from the aperture. In the shown embodiment, the scraper 1180 includes four blades positioned equidistant thereabout, and each blade is adapted to ride along an interior of the tubing or close with the tubing. As the scraper 1180 oscillates within the tubing, the blades of the scraper 1180 contacts wax disposed on the interior of the tubing and causes the wax to separate from the tubing.

In the shown embodiment, the dewaxer flow enhancer system 1000 includes a centralizer 1190. The centralizer 1190 comprises an annular disk that is concentric with the body 1100. The centralizer 1190 is adapted to orient the head 1200, body 1100, and dewaxing barrel 1300 to be concentric with and parallel within the tubing when received therein. In the shown embodiment, the centralizer 1190 is positioned between the body 1100 and the head 1200 and includes fasteners that join to the body 1100 and the head 1200. In alternative embodiments, the centralizer 1190 is positioned integrally with the body 1100, head 1200, and/or the dewaxing barrel 1300.

Figure 10:
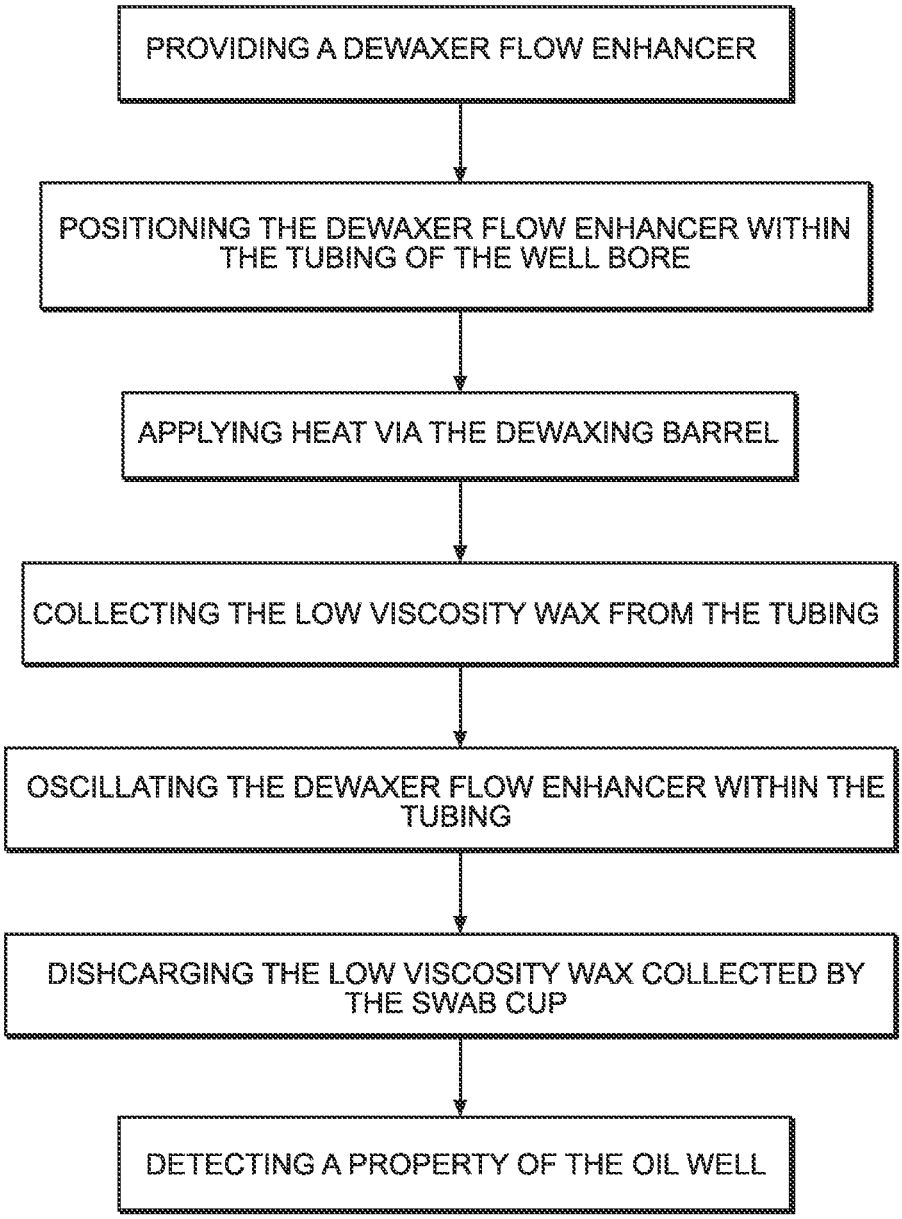
FIG. 10 shows a flow diagram of one embodiment of the method of dewaxing a tubing of a well bore to enhance flow.

Referring to FIG. 10, there is shown a flow diagram of one embodiment of the method of dewaxing a tubing of a well bore to enhance flow. The method comprises providing a dewaxer flow enhancer system. The dewaxer flow enhancer system comprises an elongated cylindrical body having a head at a first end and a dewaxing barrel at a second end. The dewaxing barrel includes a tip at a distal end thereof that is adapted to deliver heat to downhole crude oil so as to form a low viscosity wax. The head has a swab cup for collecting the low viscosity wax from the tubing of the well bore and a fastener for selectively coupling a slickline or an e-line. The method further provides for positioning the dewaxer flow enhancer within the tubing of the well bore, applying heat via the dewaxing barrel to the downhole crude oil, and collecting the low viscosity wax from the tubing of the well bore via the swab cup.

In one embodiment of the method, the oscillation of the dewaxer flow enhancer system within the tubing is configured to collect the low viscosity wax. As the dewaxer flow enhancer system oscillates, the crude oil and low viscosity wax mixture flows through the tubing to the surface. As the dewaxer flow enhancer system moves upwards within the tubing, the swab cup collects some of the low viscosity wax.

In one embodiment of the method of dewaxing the tubing of the well bore to enhance flow includes reciprocating the dewaxer flow enhancer within the well bore between a bottom hole position and a top well position via an actuator.

In another embodiment of the method, the method comprises discharging the low viscosity wax collected by the swab cup to a swab tank.

In yet another embodiment of the method, the method comprises detecting a temperature and flow of the crude oil and the low viscosity wax.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dewaxer flow enhancer system for decreasing viscosity of wax in crude oil within a tubing of a well bore and removing the wax from the tubing, comprising:

an elongated body having a head at a first end and a dewaxing barrel at a second end;

wherein the dewaxing barrel comprises a tip at a distal end thereof, the dewaxing barrel adapted to deliver heat to the crude oil so as to form a low viscosity wax;

wherein the head comprises a swab cup configured to collect the low viscosity wax from the tubing of the well bore and a fastener for selectively coupling a line;

wherein the dewaxer flow enhancer system is connected to an actuator via the line;

wherein the dewaxer flow enhancer system is adapted to reciprocate within the tubing of the well bore, and wherein the swab cup is in fluid communication with a swab tank.

2. The dewaxer flow enhancer system of claim 1, wherein the dewaxer flow enhancer is adapted to reciprocate between a bottom hole position and a top well position via the actuator;

wherein at the top well position, the head is adapted to discharge the low viscosity wax collected by the swab cup to the swab tank;

wherein at the bottom hole position, the tip is positioned within the well bore to engage the crude oil, and wherein the dewaxing barrel delivers heat to the crude oil.

3. The dewaxer flow enhancer system of claim 1, wherein the tip comprises a bull nose tip for clearing a path through the tubing.

4. The dewaxer flow enhancer system of claim 1, wherein the body is removably secured to both the head and dewaxing barrel.

5. The dewaxer flow enhancer system of claim 1, further comprising a sensor for detecting a temperature of the crude oil.

6. The dewaxer flow enhancer system of claim 5, wherein the sensor is adapted for detecting a viscosity of the crude oil.

7. The dewaxer flow enhancer system of claim 1, wherein an exterior sidewall of the body comprises an alloy of stainless steel adapted to protect and insulate internal components thereof.

8. The dewaxer flow enhancer system of claim 7, wherein the internal components comprise a power source in electrical communication with the dewaxing barrel.

9. The dewaxer flow enhancer system of claim 1, wherein the dewaxing barrel comprises an induction coil adapted to heat the wax in the crude oil to reduce the viscosity so as to enhance the flow of fluid within the tubing.

10. The dewaxer flow enhancer system of claim 1, wherein the dewaxing barrel is adapted to heat the crude oil to an operating temperature of between 130 and 170 degrees Centigrade.

11. The dewaxer flow enhancer system of claim 1, wherein the elongated body comprises a cylindrical shape.

12. A method of dewaxing a tubing of a well bore to enhance flow, the method comprising:

providing a dewaxer flow enhancer system, the dewaxer flow enhancer system comprising:

an elongated cylindrical body having a head at a first end and a dewaxing barrel at a second end;

wherein the dewaxing barrel comprises a tip at a distal end thereof, the dewaxing barrel adapted to deliver heat to downhole crude oil so as to form a low viscosity wax;

wherein the head comprises a swab cup configured to collect the low viscosity wax from the tubing of the well bore and a fastener for selectively coupling a line;

positioning the dewaxer flow enhancer system within the tubing of the well bore with an actuator via the line;

applying heat via the dewaxing barrel to the downhole crude oil to form a low viscosity wax;

collecting the low viscosity wax from the tubing of the well bore via the swab cup; and discharging the low viscosity wax collected by the swab cup to a swab tank.

13. The method of dewaxing the tubing of the well bore to enhance flow of claim 12, further comprising: oscillating the dewaxer flow enhancer system within the tubing to collect the low viscosity wax.

14. The method of dewaxing the tubing of the well bore to enhance flow of claim 12, further comprising: reciprocating the dewaxer flow enhancer system within the well bore between a bottom hole position and a top well position via an actuator.

15. The method of dewaxing the tubing of the well bore to enhance flow of claim 14, wherein at the bottom hole position, the tip is positioned within the bore hole to engage the crude oil and the dewaxing barrel delivers heat to the crude oil.

16. The method of dewaxing the tubing of the well bore to enhance flow of claim 12, further comprising: detecting a temperature of the crude oil and the low viscosity wax.

* * * * *